United States Patent [19]

Mathey

[11] Patent Number: 5,056,407

[45] Date of Patent: Oct. 15, 1991

[54] ROCKET RETAINER IN A LAUNCHING DEVICE

[75] Inventor: Christoph Mathey, Ockenfels, Fed. Rep. of Germany

[73] Assignee: Dynamit Nobel AG, Troisdorf, Fed. Rep. of Germany

[21] Appl. No.: 608,261

[22] Filed: Nov. 2, 1990

[30] Foreign Application Priority Data

Nov. 9, 1989 [DE] Fed. Rep. of Germany ..... 3937344

[51] Int. Cl.[5] ..... F41F 3/052

[52] U.S. Cl. ..... 89/1.806; 89/1.807

[58] Field of Search ..... 89/1.806, 1.807, 1.8

[56] References Cited

U.S. PATENT DOCUMENTS

| | | | |
|---|---|---|---|
| 3,011,405 | 12/1961 | Moss et al. | 89/1.806 |
| 3,398,639 | 8/1968 | Apothéloz | 89/1.806 |
| 3,444,773 | 5/1969 | Ligne | 89/1.806 |
| 3,811,360 | 5/1974 | Ricks | 89/1.807 |
| 3,842,711 | 10/1974 | Bodinaux | 89/1.807 |
| 4,550,640 | 11/1985 | Harter | 89/1.806 |

*Primary Examiner*—David H. Brown

*Attorney, Agent, or Firm*—Antonelli, Terry, Stout & Kraus

[57] ABSTRACT

By the installation of elastic elements between a rocket and a retaining sleeve (or, respectively, a retaining sleeve and a launching device, or within a launching device), peak loads are reduced and breakage of a connecting member or, respectively, of the parts of the retaining sleeve corresponding to this connecting member is avoided.

8 Claims, 2 Drawing Sheets

ROCKET RETAINER IN A LAUNCHING DEVICE

BACKGROUND OF THE INVENTION

This invention relates to a rocket retainer in a launching device for at least one rocket inserted in a retaining sleeve connectible to the launching device wherein the mounting of the rocket in the retaining sleeve is accomplished by way of a connecting member, the connecting member exhibiting a conical end which can be expanded and positioned by means of a displacement pin on the detachable sealing lid of the retaining sleeve, the expanded connecting member engaging at the retaining sleeve and the connection of the rocket with the retaining sleeve being releasable by removal of the displacement pin.

In a conventional launching device for rockets, each rocket is disposed in a retaining sleeve with a sealing lid which lid is expelled during launching of the rocket by the pressure in the rocket nozzle. Each retaining sleeve is rigidly joined to the launching device by way of a locking pawl. The fastening of the rocket in the retaining sleeve is effected via expansible clamping jaws at the rear zone of the rocket, the retaining sleeve comprising conically formed regions therein, corresponding to the contours of the expanded clamping jaws. Positioning of the clamping jaws is brought about by a displacement pin attached to the sealing lid of the retaining sleeve. Upon ignition of the rocket, the sealing lid is expelled toward the rear by the gas pressure and during this step the displacement pin is simultaneously pulled out of the expanded clamping jaws. If the displacement pin is missing, the expanded clamping jaws can be compressed toward the longitudinal axis, and thereby the rigid coupling of the rocket with the retaining sleeve and thus also with the launching device is eliminated; the rocket can leave the launcher.

The launching device also takes over, in part, the function of a transporting means for the rocket. During transport and transfer, high acceleration forces can act on the expansible clamping jaws, which can lead to breakage of these elements and, under certain circumstances, also to other damage to the projectile.

SUMMARY OF THE INVENTION

It is an object of the invention to avoid damage to the rocket retainer; in particular, the peak loads during transport and transfer, occurring in the region of the expansible clamping jaws and in the extension in the retaining sleeve corresponding thereto, are to be reduced.

This object has been attained by means of a launching device of the type heretofore described by providing that at least one damping elastic element is arranged between the rocket and the launching device in such a way that, upon an axial movement of the rocket, deformation of the elastic element occurs. Specific embodiments are described hereinafter.

On account of the elastic elements, which are preferably pretensioned, the peaks of the acceleration and, respectively, deceleration forces resulting from handling, transfer, and transport are smoothed to such an extent that the materials are no longer stressed past their load limits and thereby breakage does no longer occur.

BRIEF DESCRIPTION OF THE DRAWINGS

Four embodiments of the invention are shown in the accompanying drawings and will be further described hereinafter. In the drawings:

In FIGS. 1 through 4, the connection of a rocket 1 (having a rocket axis 2) with a launching device 3 is depicted in each case. A bolt 7 is attached in a nozzle rim 4 of the rocket 1 in a bore 5 by means of a pin 6. Two spring element 8, 9 are placed on the bolt 7. The bolt 7 is joined to a connecting element 10' (the pin 7 and the connecting element 10' forming a connecting member 10) by the feature that a collar 11 is retained on the inside of the tubular connecting element 10' between the two spring elements 8, 9. The conically shaped end 12 of the connecting element 10', which end can be spread apart and positioned by a displacement pin 15, is inserted in shape-mating fashion in a correspondingly conically shaped bore 13 in the retaining sleeve 14. The displacement pin 15 is attached to the sealing lid 16. The sealing lid 16 is conventionally retained at the retaining sleeve 14 by small shear screws 17. The retaining sleeve 14 lies with its forward rim 18 in contact with a stop 19 in the launching device 3 and is held therein by means of a spring-loaded locking pawl 21 engaged in shape-mating fashion behind the cam 20 provided on the side of the retaining sleeve.

Figure 1:
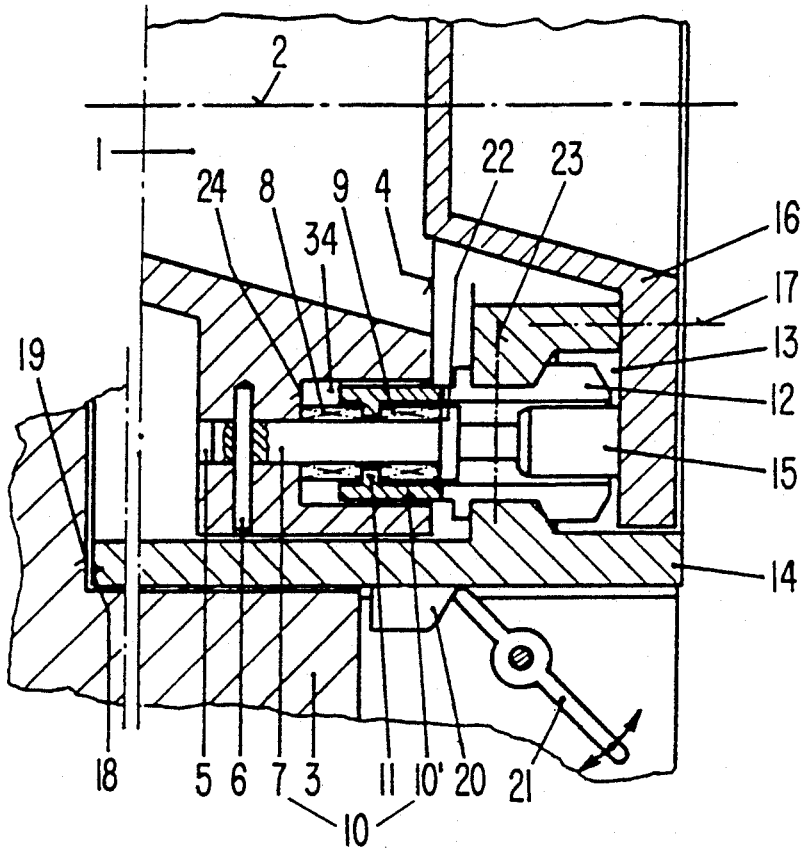
FIG. 1 is a fragmentary sectional view of the zone of the connection of a rocket with a launching device with elastic elements between the rocket and the retaining sleeve, the elastic elements being mounted on a bolt.

If, during handling, during transfer and transport, the launching device 3, loaded with the rocket 1, experiences an impact in the launching direction, then the spring element 9 between the collar 11 of the connecting element 10' and the collar 22 of the bolt 7 is elastically deformed, for example, compressed. Thereby, the acceleration force (tensile force) in the critical cross section 23 of the connecting element 10' is reduced to such an extend that no breakage of material and/or damage to the structural element occurs.

Upon acceleration of the rocket 1 in a direction oppositely to the launching direction, the other spring element 8 between the bottom 24 of the bore 34 and the collar 11 at the connecting element 10' is elastically deformed, likewise resulting in a corresponding reduction of the acceleration peaks.

Figure 2:
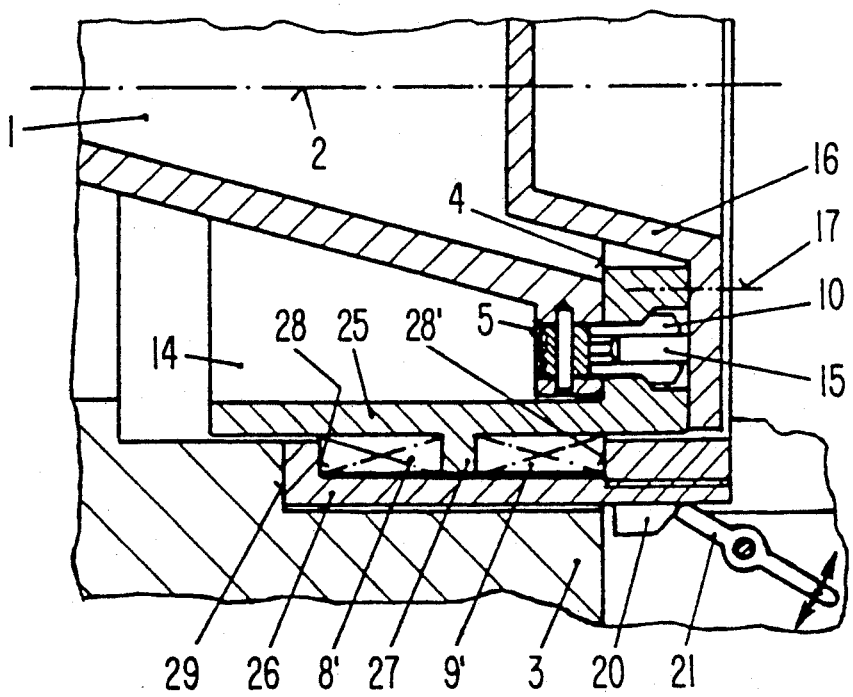
FIG. 2 is a fragmentary sectional view of the zone of the connection of a rocket with a launching device with elastic elements within the bipartite jacket of the retaining sleeve.

FIG. 2 also shows a partial sectional view of the rocket 1 with the launching device 3 having a somewhat differently fashioned retaining structure. The retaining sleeve 14 has an interior jacket section 25 and an exterior jacket section 26 displaceable relatively to each other in the axial direction 2. The spring elements 8', 9' in this embodiment are inserted in between the jacket sections 25 and 26. The inner jacket section 25 of the retaining sleeve 14 is rigidly connected with the rocket 1, and likewise the outer jacket section 26 is rigidly joined to the launching device 3; however, the jacket sections are mutually elastically retained because a collar 27 on the outside of the interior jacket section 25 engages into the gap between two spring elements 8', 9'. The mode of operation of the spring elements 8', 9' in conjunction with the stops 28, 28' takes place correspondingly to the embodiment described in FIG. 1. The required fixation of the rocket 1 in the launching device 3 is provided by abutting at the rim 29 of the launching device 3, in conjunction with the locking pawl 21.

Figure 3:
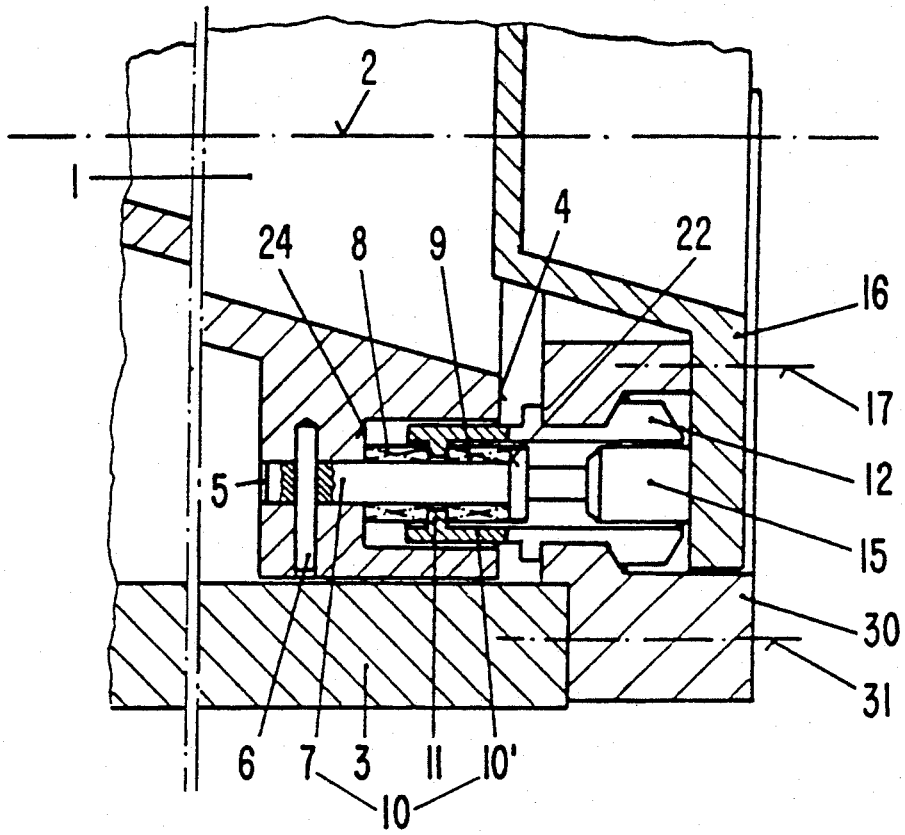
FIG. 3 is a fragmentary sectional view of the zone of the connection of a rocket with a launching device with elastic elements between the rocket and a retaining ring wherein the elastic elements are mounted on a bolt.

The expense in structural parts is considerably reduced by the arrangement illustrated in FIG. 3. A retaining ring 30 is provided in place of the retaining sleeve 14, the ring being firmly connected to the launching device 3, for example by way of screws 31. Accordingly, not only is the retaining sleeve 14 eliminated, but also its relatively complicated mounting and arresting in the launching device 3. The function of the connecting element 10' and of the elastic elements 8 and 9 is the same as in the embodiment of FIG. 1.

Figure 4:
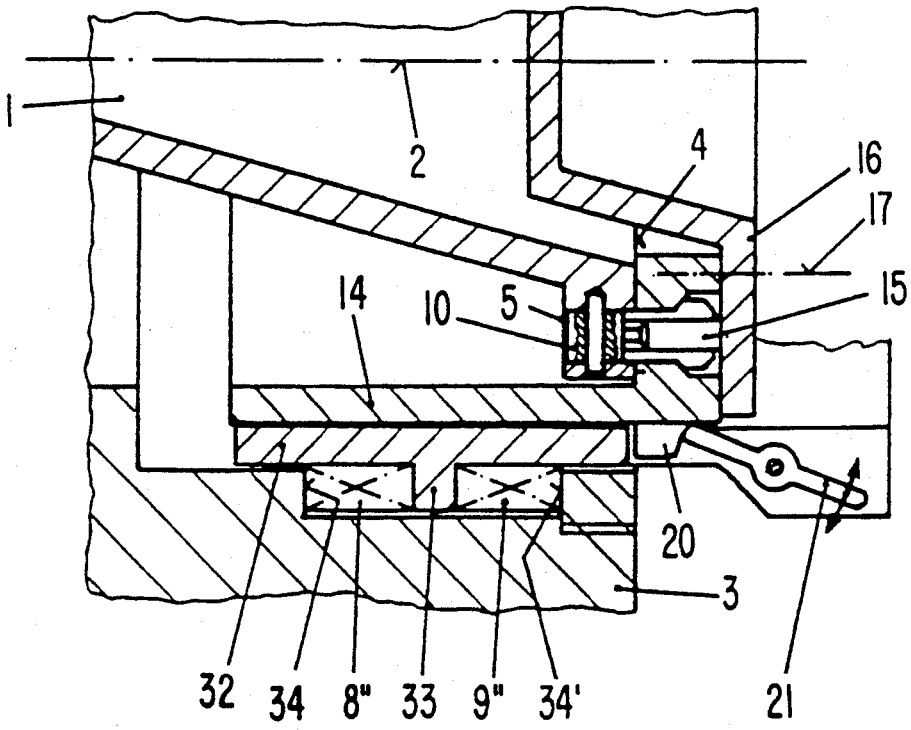
FIG. 4 is a fragmentary sectional view of the zone of the connection of a rocket with a launching device with elastic elements within the launching device.

Especially in case of reloadable launching devices, it can be advantageous to relocate the elastic element from the connecting member 10 and, respectively, from the retaining sleeve 14 into the launching device 3. Such a structure is shown in FIG. 4.

A retaining sleeve mounting 32 is disposed in the launching device 3; this mounting is retained by way of the collar 33 attached to the latter, this collar engaging between the elastic elements 8'' and 9''.

Upon movement of the rocket 1 relatively to the launching device 3 in the direction of the rocket axis 2, the elastic elements 8'' and 9'', respectively, are elastically deformed by way of the retaining sleeve mounting 32 and the relative motion is decelerated toward zero.

What is claimed is:

1. A rocket retainer in a launching device for at least one rocket inserted in a retaining sleeve connectible to the launching device wherein the attachment of the rocket in the retaining sleeve takes place via a connecting member, the connecting member exhibiting a conical end which can be expanded and positioned by means of a displacement pin at a detachable sealing lid of the retaining sleeve, the expanded connecting member engaging at the retaining sleeve, and the connection of the rocket with the retaining sleeve being releasable by removal of the displacement pin, characterized in that at least one damping elastic element is provided between the rocket and the launching device in such a way that, upon an axial movement of the rocket, deformation of an elastic element takes place.

2. A rocket retainer according to claim 1, characterized in that the elastic elements are pretensioned.

3. A rocket retaining according to claim 1, characterized in that at least one damping elastic element is provided between the rocket and the retaining sleeve in such a way that, upon axial movement of the rocket, deformation of an elastic element takes place.

4. A rocket retainer according to claim 3, characterized in that the connecting member comprises two parts, including a bolt connected to the rocket and a tubular connecting element with a conical end on a side facing away from the bolt, the bolt being surrounded by two elastic elements, between which an annular gap is present, stops for the elastic elements being arranged on the side facing away from the annular gap, and the tubular connecting element exhibiting on its inside a collar engaging into the annular gap between the two elastic elements.

5. A rocket retainer according to claim 1, characterized in that at least one damping elastic element is provided in the retaining sleeve in such a way that, upon axial movement of the rocket deformation of an elastic element occurs.

6. A rocket retainer according to claim 5, characterized in that the retaining sleeve comprises an interior jacket section and an exterior jacket section, the shape-mating connection with the launching device being established by way of the exterior jacket section, wherein two elastic elements are arranged on an inside gap being present between these elastic elements, stops for the elastic elements being provided on sides facing away from the annular gap, and the interior jacket section exhibiting a collar on the outside, this collar engaging into the annular gap between the elastic elements

7. A rocket retainer according to claim 1, characterized in that axially movable retaining sleeve mounting with at least one elastic element is provided between the retaining sleeve and the launching device, in such a way that, upon an axial movement of the rocket, deformation of an elastic element occurs.

8. A rocket retainer according to claim 7, characterized in that the retaining sleeve mounting comprises a ring with an externally arranged collar, two elastic elements being mounted on the outside around the retaining sleeve mounting, the collar engaging between these elements, and stops being provided on the sides facing away from the collar for the elastic elements in the launching device.

* * * * *